US006980172B2

(12) United States Patent
Kwak et al.

(10) Patent No.: US 6,980,172 B2
(45) Date of Patent: Dec. 27, 2005

(54) MULTI-BAND CABLE ANTENNA

(75) Inventors: Won Il Kwak, Yuseong-Gu (KR); Seong Ook Park, Yuseong-Gu (KR)

(73) Assignee: Information and Communications University Educational Foundation, Seoul (KR)

( * ) Notice: Subject to any disclaimer, the term of this patent is extended or adjusted under 35 U.S.C. 154(b) by 0 days.

(21) Appl. No.: 10/780,642

(22) Filed: Feb. 19, 2004

(65) Prior Publication Data

US 2005/0128157 A1 Jun. 16, 2005

(30) Foreign Application Priority Data

Dec. 13, 2003 (KR) ..... 10-2003-0090921

(51) Int. Cl.[7] ..... H01Q 9/04
(52) U.S. Cl. ..... 343/791; 343/700 MS; 343/830
(58) Field of Search ..... 343/700 MS, 830, 343/846, 791

(56) References Cited

U.S. PATENT DOCUMENTS 4,853,703 A * 8/1989 Murakami et al. ... 343/700 MS
5,008,681 A * 4/1991 Cavallaro et al. .... 343/700 MS
5,420,596 A * 5/1995 Burrell et al. ..... 343/700 MS
5,585,806 A * 12/1996 Ogino et al. ..... 343/700 MS
5,627,550 A * 5/1997 Sanad ..... 343/700 MS
6,121,930 A * 9/2000 Grangeat et al. .... 343/700 MS
6,285,325 B1 * 9/2001 Nalbandian et al. . 343/700 MS
6,304,219 B1 * 10/2001 Rothe ..... 343/700 MS
6,879,292 B2 * 4/2005 Shikata et al. ..... 343/700 MS

* cited by examiner

*Primary Examiner*—Tan Ho
(74) *Attorney, Agent, or Firm*—Oblon, Spivak, McClelland, Maier & Neustadt, P.C.

(57) ABSTRACT

The present invention is directed to a multi-band cable antenna. A multi-band cable antenna according to the present invention comprises: a dielectric substrate, as a nonconductive dielectric having a predetermined dielectric constant, with a plurality of conductive microstrips formed on the top and bottom sides of the substrate, for inducing a resonance in the multi-band; signal transfer means including the first and second conductors for signal transfer, which are electrically separated from each other by a layer of insulator, the first conductor for signal transfer configured to be short-circuited with one of microstrips formed on the top side of the dielectric substrate; a conductive solder ball for physically coupling one of the conductors for signal transfer with the microstrips formed on the top side of the dielectric substrate; and an upper and lower short-circuited conductor for short-circuited the second conductor for signal transfer on the signal transfer means with one of the micristrips formed on the bottom side of the dielectric substrate, wherein the upper and lower short-circuited conductor and the microstrips formed on the bottom side circuit-shorted with the second conductor of signal transfer are electrically grounded.

4 Claims, 4 Drawing Sheets

MULTI-BAND CABLE ANTENNA

BACKGROUND OF THE INVENTION

1. Field of the Invention

The present invention relates to an antenna, and more particularly to an antenna used for mobile communication services.

2. Description of the Related Art

With remarkable development of informalization, modern society has been developing day by day. Mobile communication systems are main means for transmitting a mass of information correctly and quickly. These mobile communication services require a variety of terminal components. Particularly, many core components like antennas for terminal device depend on imported products. Therefore, there is a keen need for development of domestic-manufactured antenna for mobile communication terminal device.

Terminal devices used for the mobile communication services are connected to duplexers to separate input and output signals each other. Typically, a compact antenna mounted on the uppermost of a terminal device is used as a final stage in a state of signal output, and is used as a start stage in a state of signal input. In this way, the antennas for mobile communication services perform a function to receive radio waves from the outside (for example, base stations, relays, or antennas attached to wireless communication devices) or transfer electric signals generated in communication devices to the outside. One of these antennas is a monopole type with a length of a quarter wavelength.

According to user's demand for good design, convenience of carrying, service commerciality in a multi-band, light weight of antennas for mobile communication, markets for portable terminal devices for mobile communication have a preference for internal antennas of the multi-band including an 800 MHz band over external antennas. In addition, according to a need for miniaturization of antennas, sizes of the antennas get smaller using a variety of structures and materials.

While Microstrip Antennas have an advantage of light weight, low profile, easiness in making into linear form or planar array, and easiness of integration into a high frequency circuit, they, have a disadvantage of narrow band characteristics, difficulty of precise polarization, and limitation of power capacity.

SUMMARY OF THE INVENTION

In consideration of the above problem, it is an object of the present invention to improve an environment adaptability of microstrip type antenna by making the micrstrip type antenna possible to be used for-the external as well as for the internal.

It is another object of the present invention to cover CDMA (824 MHz~894 MHz), GSM (880 MHz~960 MHz), GPS (1.57542 GHz), DCS (1.71 GHz~1.88 GHz), PCS (1.75 GHz~1.87 GHz), UPCS (1.85 GHz~1.99 GHz), Bluetooth (2.4 GHz~2.4835 GHz), W-LAN (5.15 GHz~5.875 GHz) and the like through a single antenna.

In order to achieve the above objects, according to one aspect of the present invention, a multi-band cable antenna comprises a microstrip antenna provided in both sides of a dielectric for inducing a resonance of a multi-band, and a multi-layered cable including a feeder and a ground line, both of which are coupled to a microstrip, the microstrip antenna and the cable connected to each other.

DESCRIPTION OF THE PREFERRED EMBODIMENTS

Now, a preferred embodiment of the present invention will be described in detail with reference to the accompanying drawings.

Figure 1:
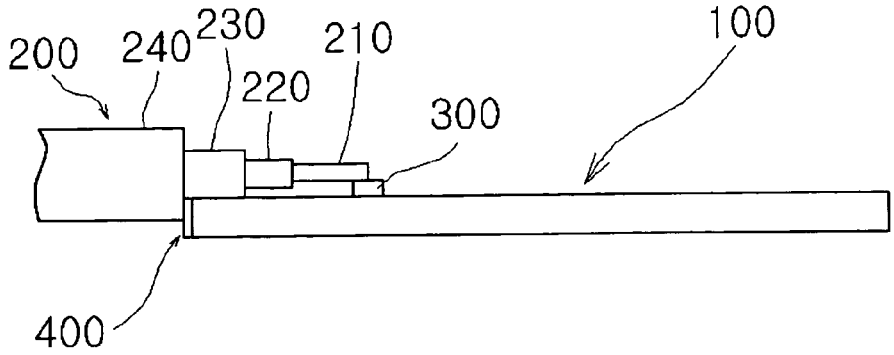
FIG. 1 is a side view illustrating a multi-band cable antenna according to the present invention.

FIG. 1 is a side view illustrating a multi-band cable antenna according to the present invention. As shown in FIG. 1, a multi-band cable antenna is composed of a dielectric substrate 100, a cable 200, a solder ball 300 and an upper and lower circuit-short conductor 400 and the like.

The dielectric substrate 100 is a plate having a predetermined dielectric constant, with microstrip type antennas to allow a multi-band resonance, provided on top and bottom sides of the substrate 100. In order to increase an impedance bandwidth of the microstrip antennas, the thickness of the substrate may be increased or a substrate having a low dielectric constant may be used. However, when the thickness of the substrate is increased, a distortion of an antenna pattern is generated, a surface wave is increased, radiation efficiency is deteriorated and a high order mode to distort an impedance characteristic is produced. In addition, since a wide band technique using a low dielectric constant has a limit to the reduction of dielectric constant, its wide band characteristic is limited. In the end, the dielectric substrate is used with a thickness and dielectric constant selected properly in consideration of the usage of frequency band and the like.

The cable 200 is a signal transmission line with a conductor and an insulator stacked alternately. The cable 200 of the present invention is composed of layers of conductors 210 and 230 and layers of insulators 220 and 240 inserted between the conductors 210 and 230.

A layer of conductor 210 is used as a feeder and a layer of conductor 230 is used as a ground line. The feeder 210 is connected to one of microstrips formed on the top side of the substrate 100 for transmitting signals. The feeder 230 is connected to another of the microstrips formed on the top side of the substrate 100 and is electrically short-circuited to microstrips formed on the bottom side of the substrate 100 via the upper and lower circuit-short conductor 400 provided on a side surface of the substrate 100.

The solder ball 300 connects the microstrips and the feeder by coupling one of the microstrips formed on the top side of the substrate 100 with the feeder 210 of the cable 200 electrically/mechanically, such that the microstrips and the feeder are not easily detached each other.

Figure 2:
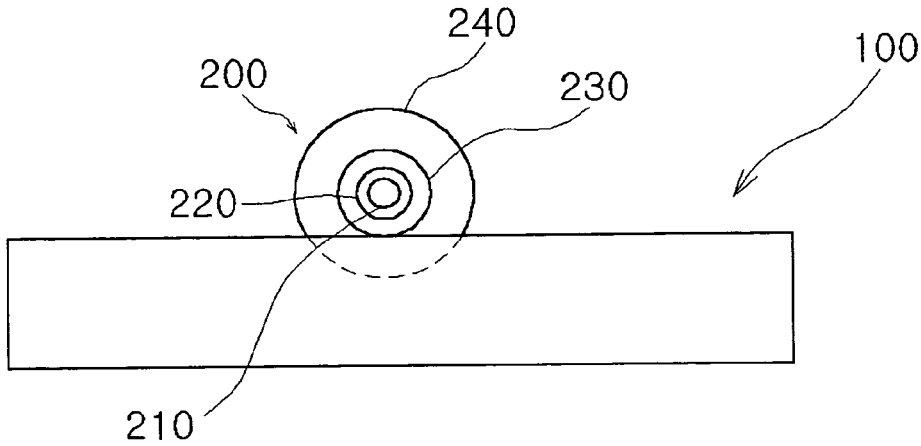
FIG. 2 is a front view illustrating a multi-band cable antenna according to the present invention.

FIG. 2 is a front view illustrating a multi-band cable antenna according to the present invention.

The cable 200 is composed of the feeder 210, a first layer of insulator 220 for insulating a circumference of the feeder 210 concentrically, the ground line 230 provided concentrically along a circumference of the first layer of insulator 220, a second layer of insulator 240 for insulating a circumference of the ground line concentrically so that the cable is protected from the outside, etc. Here, the second layer of insulator 240 has no effect on a characteristic of the antenna although it is removed from the cable.

As shown in FIG. 2, since the ground line 230 is in the same plane as the top side of the substrate 100, the microstrip on the top side of the substrate 100 and the ground line 230 are short-circuited by only a contact without any physical combination means.

On the other hand, since the feeder 210 is above the top side of the substrate 100, the feeder 210 can be bent toward and contact with the top side of the substrate 100. However, the feeder 210 is preferable to electrically connect with the microstrip on the top side of the substrate 100 by using the solder ball 300 and the like.

Figure 3:
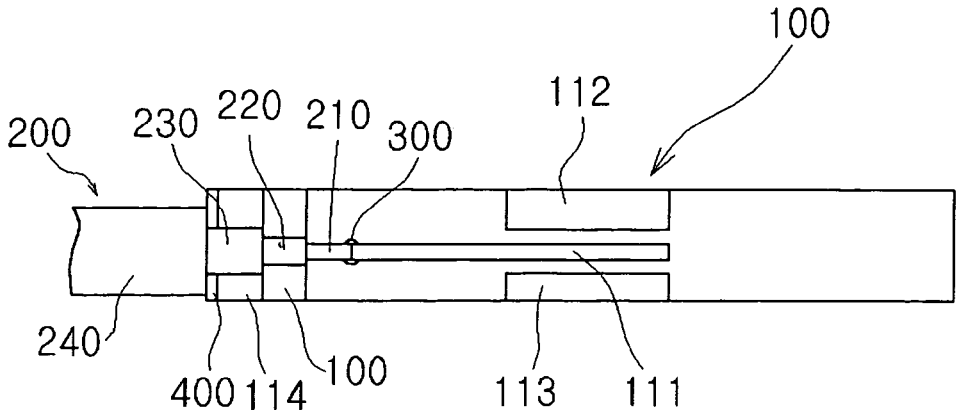
FIG. 3 is a top view illustrating a multi-band cable antenna according to the present invention.

FIG. 3 is a top view illustrating a multi-band cable antenna according to the present invention. A plurality of microstrips 111, 112, 113 and 114 is formed on the top side of the substrate 100.

The microstrip 111 is physically short-circuited with the feeder 210 of the cable 200 by the solder ball 300.

The microstrip 114 is in contact with the ground line 230 of the cable 200, and is provided at the end of the microstrip 114 with the upper and lower conductor 400 for short-circuiting the ground line 230 of the cable 200, the microstrip 114 on the top side, and a microstrip (125 in FIG. 6) on the bottom side of the substrate 100. Here, the upper and lower circuit-short conductor 400 is a via hole with a conductor coated on an inner wall of the via hole for electrically short-circuiting the microstrip 114 on the top side and the microstrip (125 in FIG. 6) on the bottom side. Alternatively, the upper and lower short-circuited conductor 400 can be configured as a microstrip attached to a side portion of an edge of the substrate 100 by a length of a width of the substrate in a width direction of the substrate.

Figure 4:
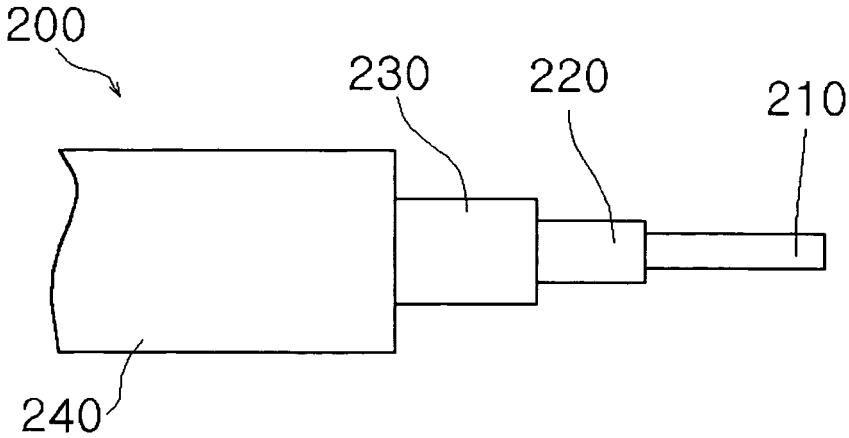
FIG. 4 is a sectional view illustrating an optical cable according to the present invention.

FIG. 4 is a sectional view illustrating an optical cable according to the present invention. As shown in FIG. 4, the cable 200 is composed of a coaxial cable with the feeder 210, the first layer of insulator 220, the ground line 230 and the second layer of insulator 240 provided in order from a center of the cable.

Figure 5:
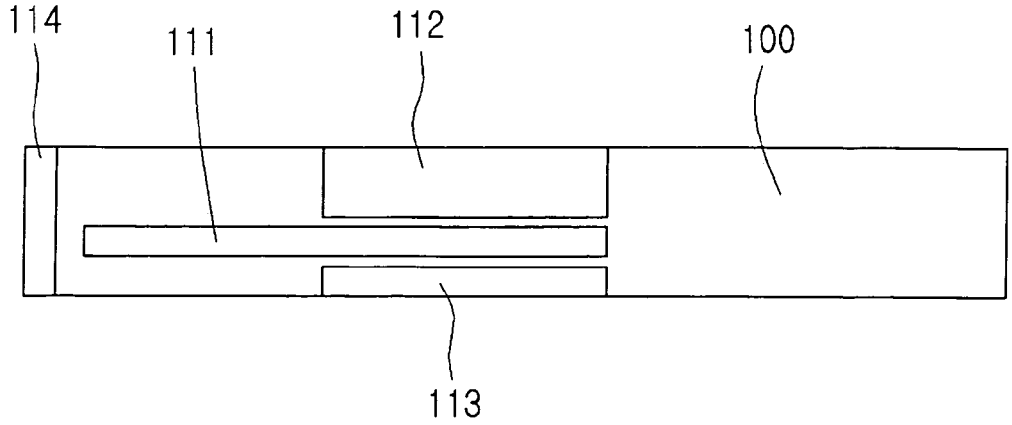
FIG. 5 is a top view illustrating a shape of microstrip formed on a top surface of a substrate 100.

FIG. 5 is a top view illustrating a shape of microstrip formed on a top surface of a substrate 100. As shown in FIG. 5, the plurality of microstrips 111~114 is formed on the top side of the substrate 100.

The microstrip 111 is connected to the feeder 210 of the cable 200 by the solder ball 300 for transferring receiving signals of the antenna to the cable, and receiving and radiating signals of a portable terminal device from the cable 200. Here, the microstrip 111 is of the form of monopole. In addition, the microstrip 111 is coupled with the microstrips (121~129 in FIG. 6) on the bottom side of the substrate 100 for lowering a resonance frequency and expanding a resonance band by increasing a capacitance of an input impedance.

The microstrip 114 in contact with the ground line 230 of the cable 200 functions as a ground and is short-circuited with the microstrip (125 in FIG. 6) of the bottom side of the substrate by the upper and lower short-circuited conductor 400 provided on the side portion of the substrate 100.

Although the microstrips 112 and 113 are not short-circuited with other microstrips, they lower the resonance frequency and expand the resonance band by increasing the capacitance of the input impedance by a coupling with the microstrips (121~129 in FIG. 6) on the bottom side of the substrate 100.

Figure 6:
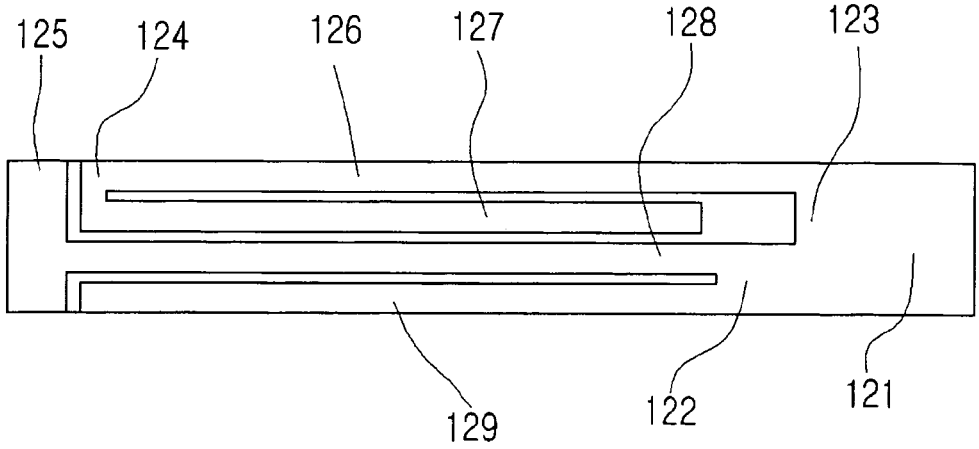
FIG. 6 is a bottom view illustrating a shape of microstrip formed on a bottom surface of a substrate 100.

FIG. 6 is a bottom view illustrating a shape of microstrip formed on a bottom surface of a substrate 100. As shown in FIG. 6, the plurality of microstrips 121~129 is formed on the top side of the substrate 100.

Electrical signals transferred through the ground line 230 of the cable 200 are transmitted to the microstrips 121~124 and 126~129 on the bottom side of the substrate 100 through an electrical short-circuited structure from the microstrip 114 on the top side, the upper and lower short-circuit conductor 400 to the microstrip 125 of the bottom side. On the other hand, the microstrips 121~124 and 126~129 on the bottom side of the substrate 100 are coupled by a coupling with the microstrips 111, 112 and 113 of the top side of the substrate 100. As a whole, the microstrips 121~129 on the bottom side of the substrate 100 function as the ground of antenna and induce the resonance in the multi-band.

The antenna of the present invention causes a current to flow by short-circuiting a signal line directly provided from a RF module or a connector with the cable. A transferred current radiates electromagnetic energy to the air at a proper resonance frequency while flowing the microstrips formed on the top and bottom sides of the antenna via the cable. The antenna of the present invention used the microstrips and the dielectric substrate in order to reduce the size of antenna such that the antenna is smaller than a monopole antenna having a length of a general half wavelength or ¼ wavelength or so.

On the other hand, the input impedance of the antenna can be adjusted by varying the width and length of metal conductor, the dielectric constant and the like.

Figure 7:
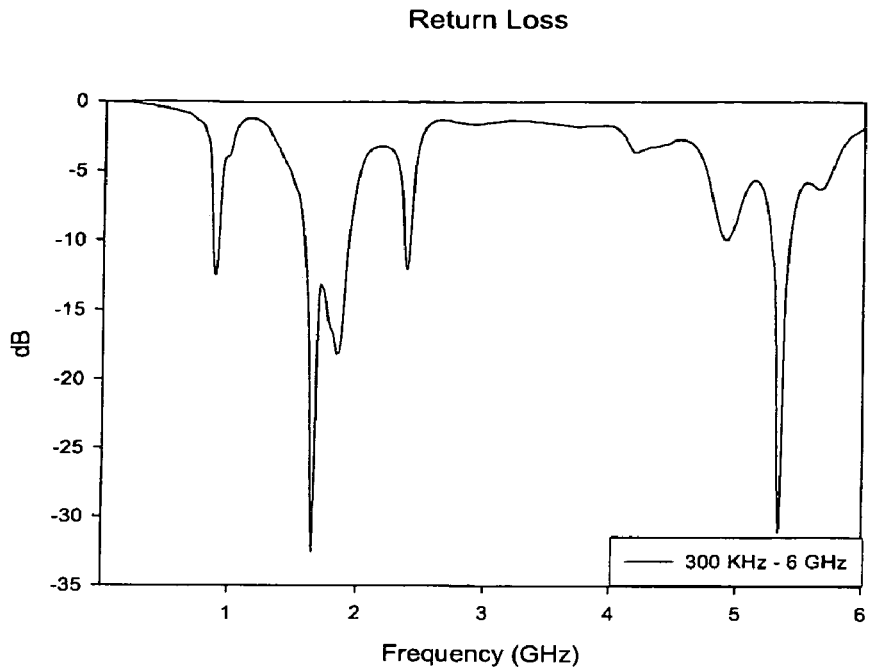
FIG. 7 is graph showing a return loss measured in each band using an antenna according to the present invention.

FIG. 7 is a graph showing a return loss measured in each band using an antenna according to the present invention. For the measurement, Agilent E8357A (300 KHz~6 GHz) PNA Series Network Analyzer was used. FIG. 7 shows that the antenna of the present invention can be used in the CDMA, GSM, GPS, DCS, UPCS, Bluetooth, and W-LAN (Bluetooth+5 GHz) bands.

Figure 8:
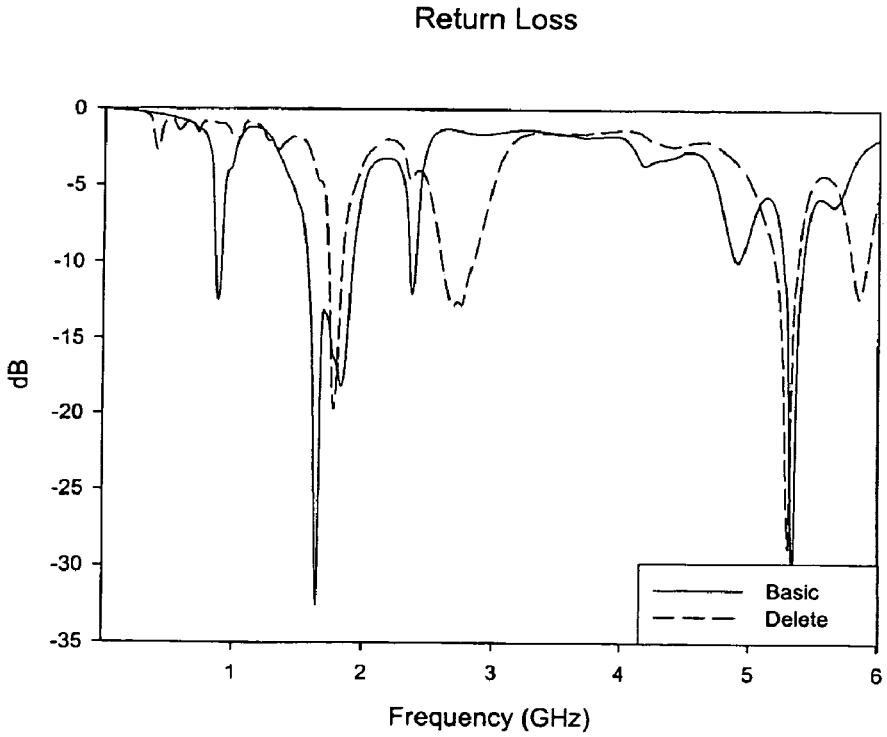
FIG. 8 is graph showing a return loss measured in a state where an upper and lower circuit-short conductor 400 is removed in an antenna structure.

FIG. 8 is a graph showing a return loss measured in a state where the upper and lower short-circuit conductor 400 is removed from an antenna structure. From FIG. 8, when the upper and lower short-circuit conductor 400 is removed, it can be seen that an entire structure of the ground of the antenna is changed, which results in significant variation of the antenna characteristic. The resonance in the CDMA or GSM band disappears and the bandwidth in the PCS band is greatly reduced. The resonance in the Bluetooth band moves to a low frequency, but its bandwidth is greatly increased. The resonance characteristic in 5 GHz band moves to a frequency, but its bandwidth is maintained. Accordingly, the removal of the upper and lower circuit-short conductor 400 is considerable when an antenna for exclusive use at the W-LAN is designed.

In addition, when the length of the microstrip 111 is reduced, since there is a property that the resonance characteristic in the 5 GHz band is removed, such a reduction of the length of the microstrip 111 is considerable only when the 5 GHz band is not used. In addition, when the microstrips 112 and 113 are removed, it can be seen that the antenna characteristic is not greatly varied.

In general, in a case of nonmetallic antenna, a case where the resonance frequency is placed on a desired frequency is not common due to a tolerance caused between design and production of the antenna. Therefore, a tuning process is performed in order to place the resonance frequency at the desired frequency. The antenna structure of the present invention has a plurality of tuning points through which this tuning process is smoothly performed. Therefore, the antenna characteristic in the multi-band can be optimized through modification of the length or width of the microstrips.

As described above, since the cable antenna of the present invention has a multi resonance band and various tuning points, the cable antenna allows a selective use in required frequency bands, has a good performance in each resonance band, and is omni-directional for a radiation pattern. In addition, since the microstrip antenna of the present invention can be used at the external environment, an environmental adaptability of the microstrip antenna can be improved.

What is claimed is:

1. A multi-band cable antenna comprising:

a dielectric substrate, as a nonconductive dielectric having a predetermined dielectric constant, with a plurality of conductive microstrips formed on top and bottom sides of the dielectric substrate, for inducing a resonance in the multi-band; and signal transfer means including first and second conductors for signal transfer, which are electrically separated from each other by a layer of insulator, the first conductor for signal transfer configured to be short-circuited with one of microstrips formed on the top side of the dielectric substrate, wherein the dielectric substrate further includes an upper and lower short-circuited conductor for short-circuiting the second conductor for signal transfer on the signal transfer means with one of the microstrips formed on the bottom side of the dielectric substrate, and wherein the upper and lower short-circuit conductor and the microstrips formed on the bottom side circuit-shorted with the second conductor of signal transfer are electrically grounded.

2. The multi-band cable antenna according to claim 1, wherein the upper and lower short-circuit conductor comprises a via hole passing through the dielectric substrate in a width direction, with a conductor coated on an inner wall of the via hole.

3. The multi-band cable antenna according to claim 1, wherein the upper and lower short-circuited conductor comprises a microstrip attached to a side portion of an edge of the dielectric substrate by a length of a width of the dielectric substrate in a width direction of the dielectric substrate.

4. The multi-band cable antenna according to claim 1, further comprising a conductive solder ball for physically coupling one of the conductors for signal transfer with the micro strips formed on the top side of the dielectric substrate.

* * * * *